US010302313B2

(12) United States Patent
Matsunaga et al.

(10) Patent No.: US 10,302,313 B2
(45) Date of Patent: May 28, 2019

(54) INDOOR UNIT AND AIR-CONDITIONING APPARATUS

(71) Applicant: Mitsubishi Electric Corporation, Tokyo (JP)

(72) Inventors: Naoya Matsunaga, Tokyo (JP); Takaaki Takishita, Tokyo (JP); Tatsuo Furuta, Tokyo (JP); Takahiro Komatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 123 days.

(21) Appl. No.: 15/546,689

(22) PCT Filed: May 20, 2015

(86) PCT No.: PCT/JP2015/064426
§ 371 (c)(1),
(2) Date: Jul. 27, 2017

(87) PCT Pub. No.: WO2016/185576
PCT Pub. Date: Nov. 24, 2016

(65) Prior Publication Data

US 2018/0023822 A1 Jan. 25, 2018

(51) Int. Cl.
*F24F 1/00* (2019.01)
*F24F 13/20* (2006.01)
(Continued)

(52) U.S. Cl.
CPC ..... *F24F 1/0007* (2013.01); *F24F 1/00* (2013.01); *F24F 1/0011* (2013.01); *F24F 13/20* (2013.01);
(Continued)

(58) Field of Classification Search
CPC ..... F24F 1/0007; F24F 1/0011; F24F 13/222; F24F 13/20; F24F 1/00; F24F 2013/227; F24F 2001/0074; F24F 2001/0037
See application file for complete search history.

(56) References Cited

U.S. PATENT DOCUMENTS 6,450,880 B1 * 9/2002 Asahina ..... F24F 1/0011 454/233
6,569,010 B1 * 5/2003 Miller ..... F24F 1/01 454/233
(Continued)

FOREIGN PATENT DOCUMENTS

JP H04-106420 U 9/1992
JP H05-010913 U 2/1993
(Continued)

OTHER PUBLICATIONS

International Search Report of the International Searching Authority dated Aug. 25, 2015 for the corresponding international application No. PCT/JP2015/064426 (and English translation).
(Continued)

*Primary Examiner* — Ljiljana V. Ciric
(74) *Attorney, Agent, or Firm* — Posz Law Group, PLC

(57) ABSTRACT

An indoor unit includes: a casing including a top plate and lateral plates; a motor mounted to a central part on an inner surface side of the top plate; a turbofan fixed to a rotary shaft of the motor and configured to rotate through drive of the motor; a drain pan received in the casing and mounted to the lateral plates of the casing; and a bellmouth mounted to the drain pan and configured to rectify a fluid flowing into the casing. The drain pan includes a positioning fitting having: a casing-fixing threaded hole for allowing the drain pan to be fixed to the casing with a screw; and a bellmouth-fixing threaded hole for allowing the bellmouth to be fixed to the drain pan with a screw.

7 Claims, 10 Drawing Sheets

(51) Int. Cl.
*F24F 13/22* (2006.01)
*F24F 1/0007* (2019.01)
*F24F 1/0011* (2019.01)

(52) U.S. Cl.
CPC .... *F24F 13/222* (2013.01); *F24F 2001/0037* (2013.01); *F24F 2001/0074* (2013.01); *F24F 2013/227* (2013.01)

(56) References Cited

U.S. PATENT DOCUMENTS

| | | | | |
|---|---|---|---|---|
| 6,802,361 | B2 * | 10/2004 | Hatanaka | F24F 1/0011 165/53 |
| 8,230,693 | B2 * | 7/2012 | Tsuji | F24F 1/0007 454/322 |
| 8,715,047 | B2 * | 5/2014 | Kim | F24F 1/0007 454/254 |
| 9,255,716 | B2 * | 2/2016 | Koga | F24F 1/0007 |
| 9,328,938 | B2 * | 5/2016 | Michitsuji | F24F 1/0014 |
| 10,041,691 | B2 * | 8/2018 | Fujita | F24F 1/0022 |

FOREIGN PATENT DOCUMENTS

| | | | |
|---|---|---|---|
| JP | H10-096529 | A | 4/1998 |
| JP | 2002-349892 | A | 12/2002 |
| JP | 2011-153749 | A | 8/2011 |

OTHER PUBLICATIONS

Extended European Search Report dated Jun. 21, 2017 issued in corresponding EP patent application No. 15871325.5.

* cited by examiner

INDOOR UNIT AND AIR-CONDITIONING APPARATUS

CROSS REFERENCE TO RELATED APPLICATION

This application is a U.S. national stage application of International Application No. PCT/JP2015/064426, filed on May 20, 2015, the contents of which are incorporated herein by reference.

TECHNICAL FIELD

The present invention relates to an indoor unit of, for example, an air-conditioning apparatus, and more particularly, to an adjustment of a positional relationship between a bellmouth and a fan.

BACKGROUND

In air-conditioning apparatus and similar apparatus, an indoor unit installed on an indoor side includes a blower configured to blow air by rotating a fan (impeller). Specifically, in an indoor unit of a ceiling concealed type, air flows into the indoor unit through an air inlet at a center on a lower surface side (indoor side), and flows out through air outlets on lateral sides of the lower surface side via the fan, an indoor heat exchanger, and other components. In this case, the indoor unit includes a bellmouth so that the inflow air through the air inlet is rectified and delivered to the fan. The bellmouth is formed, for example, into an annular shape (cylindrical shape) in conformity with the fan to be rotated. Further, the indoor unit of the ceiling concealed type includes a drain pan that is installed below the indoor heat exchanger so as to receive drain water generated as a result of condensation by the heat exchanger. The bellmouth is mounted to the drain pan through fixation with screws, and the drain pan is mounted to lateral plates of a casing (outer shell) of the indoor unit through fixation with screws. Meanwhile, the fan is fixed to a rotary shaft of a motor, and the motor is mounted to a top plate of the casing of the indoor unit (see, for example, Patent Literature 1).

Patent Literature

Patent Literature 1: Japanese Unexamined Patent Application Publication No. 2011-153749

In order to fix the bellmouth to the drain pan with screws, screw fixing brackets having threaded holes are mounted to the drain pan. Further, screw fixing brackets for allowing the drain pan to be fixed to the casing of the indoor unit are also mounted to the drain pan. In this case, the fixing brackets for allowing fixation of the bellmouth, and the fixing brackets for allowing the casing of the indoor unit and the drain pan to be fixed to each other are independent of each other. The drain pan is formed through molding of a synthetic resin, such as, polystyrene foam. Those fixing brackets are embedded at the time of, for example, molding the drain pan.

Note that, in conventional techniques, there has been no reference for mounting positions of the casing of the indoor unit and the drain pan, and for mounting positions of the drain pan and the bellmouth. For example, in the course of manufacture, when relationships between those positions vary at the time of operations of fixing the casing of the indoor unit and the drain pan to each other, and fixing the drain pan and the bellmouth to each other, there is a possibility in that a positional relationship between the casing of the indoor unit and the bellmouth widely varies in each indoor unit. The positional relationship between the casing of the indoor unit and the bellmouth has an influence on a clearance (gap) between the bellmouth and the fan. As a result, there is a risk in that indoor units 100 having nonuniform performance (unit performance) are manufactured.

SUMMARY

The present invention has been made to overcome the problems as described above, and it is an object of the present invention to provide, for example, an indoor unit having a configuration capable of suppressing variation of a clearance formed between a bellmouth and a fan.

According to one embodiment of the present invention, there is provided an indoor unit, including: a casing comprising a top plate and lateral plates; a motor mounted to a central part on an inner surface side of the top plate; a fan fixed to a rotary shaft of the motor and configured to rotate through drive of the motor; a drain pan received in the casing and mounted to the lateral plates of the casing; and a bellmouth mounted to the drain pan and configured to rectify a fluid flowing into the casing, the drain pan comprising a positioning fitting having a casing-fixing threaded hole for allowing the drain pan to be fixed to the casing with a screw; and a bellmouth-fixing threaded hole for allowing the bellmouth to be fixed to the drain pan with a screw.

Further, according to one embodiment of the present invention, there is provided an air-conditioning apparatus, including: the above-mentioned indoor unit; and an outdoor unit configured to supply heat to the indoor unit side.

According to the present invention, by having the positioning fitting having the casing-fixing threaded hole and the bellmouth-fixing threaded hole, a positional reference for the casing and the bellmouth can be directly set. With this, variation of a clearance between the turbohan and the bellmouth can be suppressed, thereby being capable of stabilizing unit performance of each indoor unit.

DETAILED DESCRIPTION

Figure 1:
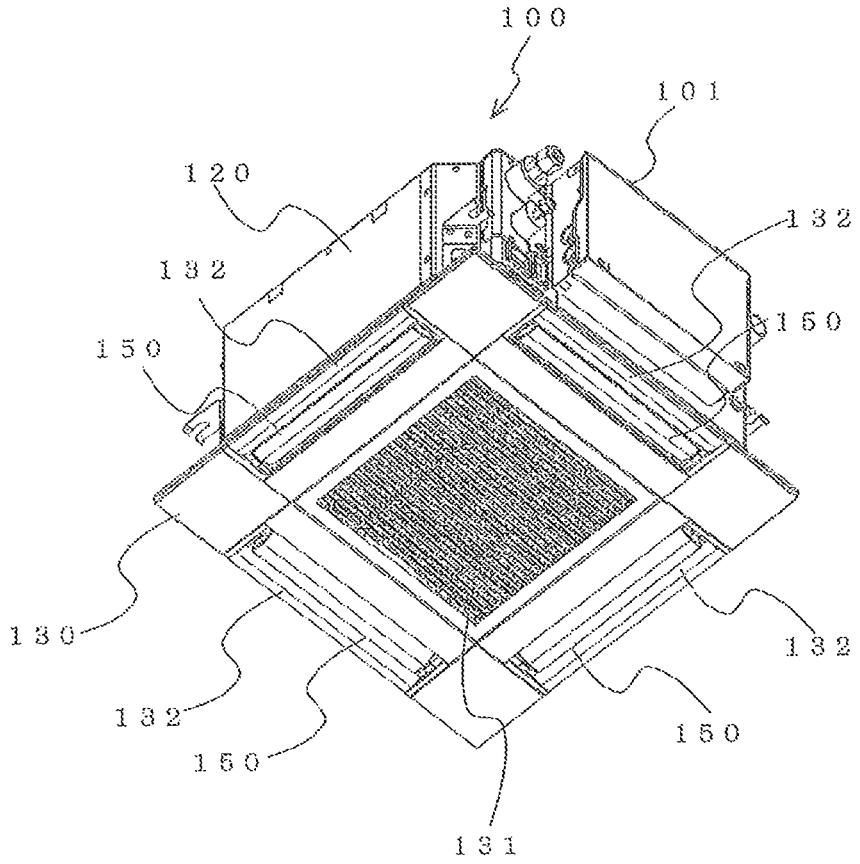
FIG. 1 is a view for illustrating an installed state of an indoor unit 100 according to Embodiment 1 of the present invention.

Now, with reference to the drawings, description is made of embodiments of the present invention. Note that, in the following drawings, the same or corresponding parts are denoted by the same reference symbols, and the same applies hereinafter. Then, the embodiments of components described herein are merely illustrative, and are not intended to be limited to those described herein. In particular, the combination of components is not limited to the combinations in the respective embodiments, and a component described in one embodiment may be applied to another embodiment. Further, only a representative one of a plurality of blades is denoted by their reference symbol. Still further, the number of the blades illustrated, for example, in the drawings is merely illustrative. In addition, the "upper side" and the "lower side" in the following description correspond respectively to the upper side and the lower side of the drawing sheets. In addition, the sizes of components relative to one another in the drawings may differ from their relative sizes in actuality.

Embodiment 1

FIG. 1 is a view for illustrating an installed state of an indoor unit 100 according to Embodiment 1 of the present invention. In this embodiment, description is made of an indoor unit 100 of a ceiling concealed type capable of being concealed in a ceiling of a room, specifically, of a four-way cassette type having air outlets 132 on four sides. Note that, the indoor unit 100 of this embodiment includes a built-in centrifugal blower. The indoor unit 100 is connected to an outdoor unit with refrigerant pipes to form a refrigerant circuit circulating refrigerant, thereby performing refrigeration, air conditioning, and other operations.

The indoor unit 100 has a casing (main unit) 120 including built-in devices configured to perform air circulation and other operations. As described later, the casing 120 includes a top plate 121 and lateral plates 122, and is opened at a side facing an indoor side (lower side). Further, a decorative panel 130 having a substantially quadrangular shape in plan view is mounted to an opening portion of the casing 120. The decorative panel 130 faces the indoor side (lower side), that is, a space to be air-conditioned (air-conditioning target space), for example. A grille 131 being an air inlet for air (gas) into the indoor unit 100 is arranged near a center of the decorative panel 130. The air that has flowed through the grille 131 is subjected to dust removal by filters (not shown).

On four sides of the decorative panel 130, the air outlets 132 are formed respectively along the four sides of the decorative panel 130. To each of the air outlets 132, an air outlet vane (flap) 150 is provided that serves as a louver configured to change a direction of airflow. Shafts of the air outlet vanes 150 are driven by motors (not shown) so that the air outlet vanes 150 are rotationally moved about their shafts. With this, positions of the air outlet vanes 150 are controlled. Further, in the indoor unit 100 of this embodiment, an electrical component box 101 is mounted to an outer surface side of the casing 120.

Figure 2:
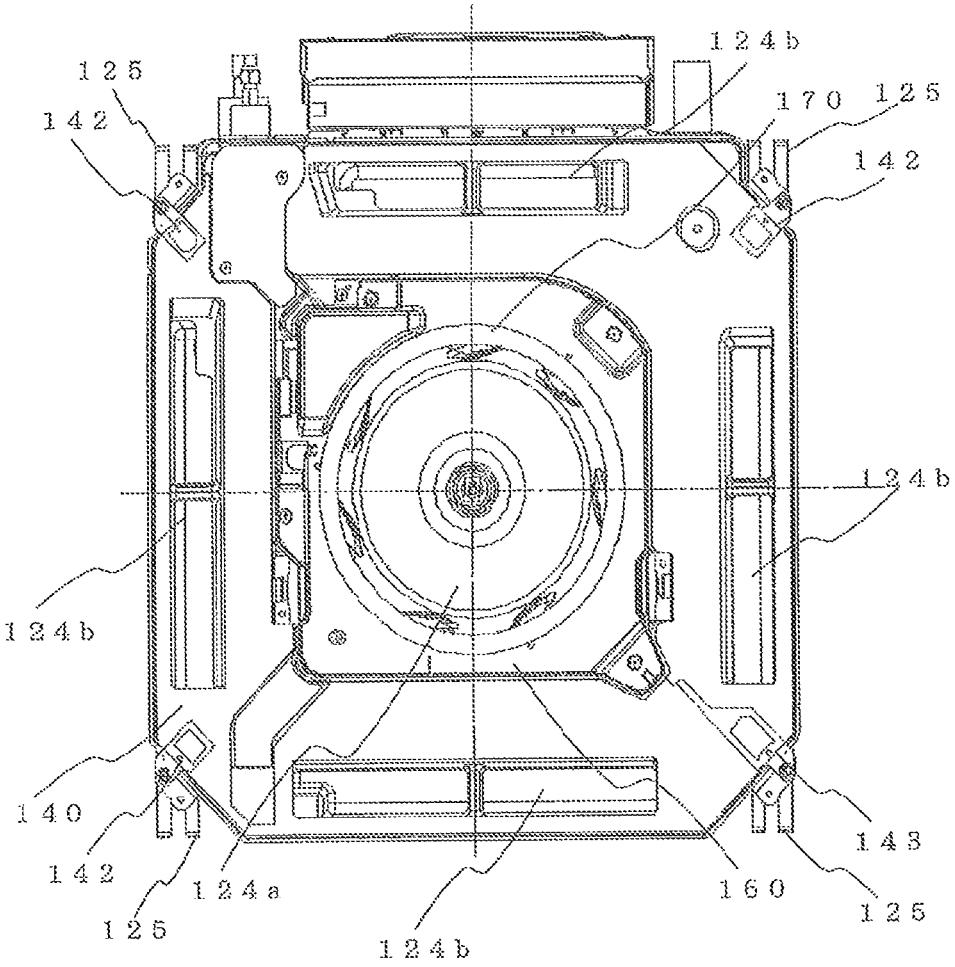
FIG. 2 is a view for illustrating the structure of the indoor unit 100 according to Embodiment 1 of the present invention as viewed from an indoor side (lower surface side).

FIG. 2 is a view for illustrating the structure of the indoor unit 100 according to Embodiment 1 of the present invention as viewed from the indoor side (lower surface side). In FIG. 2, the decorative panel 130 is not shown as being removed, for the sake of convenience of description of a relationship with the internal structure,. As illustrated in FIG. 2, on an air inflow side of the indoor unit 100, specifically, on an upstream side with respect to a turbofan (centrifugal fan) 170 being a fan (impeller), a bellmouth 160 is arranged. The bellmouth 160 is configured to rectify the inflow air from the grille 131 and guide the rectified inflow air to the turbofan 170.

A drain pan 140 is configured to collect drain water generated from an indoor heat exchanger 110 described later. The drain pan 140 is formed through molding of materials such as a synthetic resin including polystyrene foam. The bellmouth 160 is mounted to the drain pan 140, specifically, around a position corresponding to a central portion of the lower surface of the indoor unit 100. With this, there is formed a through-hole serving as a main-unit air inlet 124*a* configured to allow the inflow air from the grille 131 to flow therethrough. Further, there are formed through-holes serving as main-unit air outlets 124*b* configured to allow outflow air from the indoor heat exchanger 110 to flow therethrough so as to allow the outflow air to the air outlets 132. The grille 131, the bellmouth 160 (main-unit air inlet 124*a*), the main-unit air outlets 124*b*, and the air outlets 132 communicate to each other to form air passages in the indoor unit 100.

Figure 3:
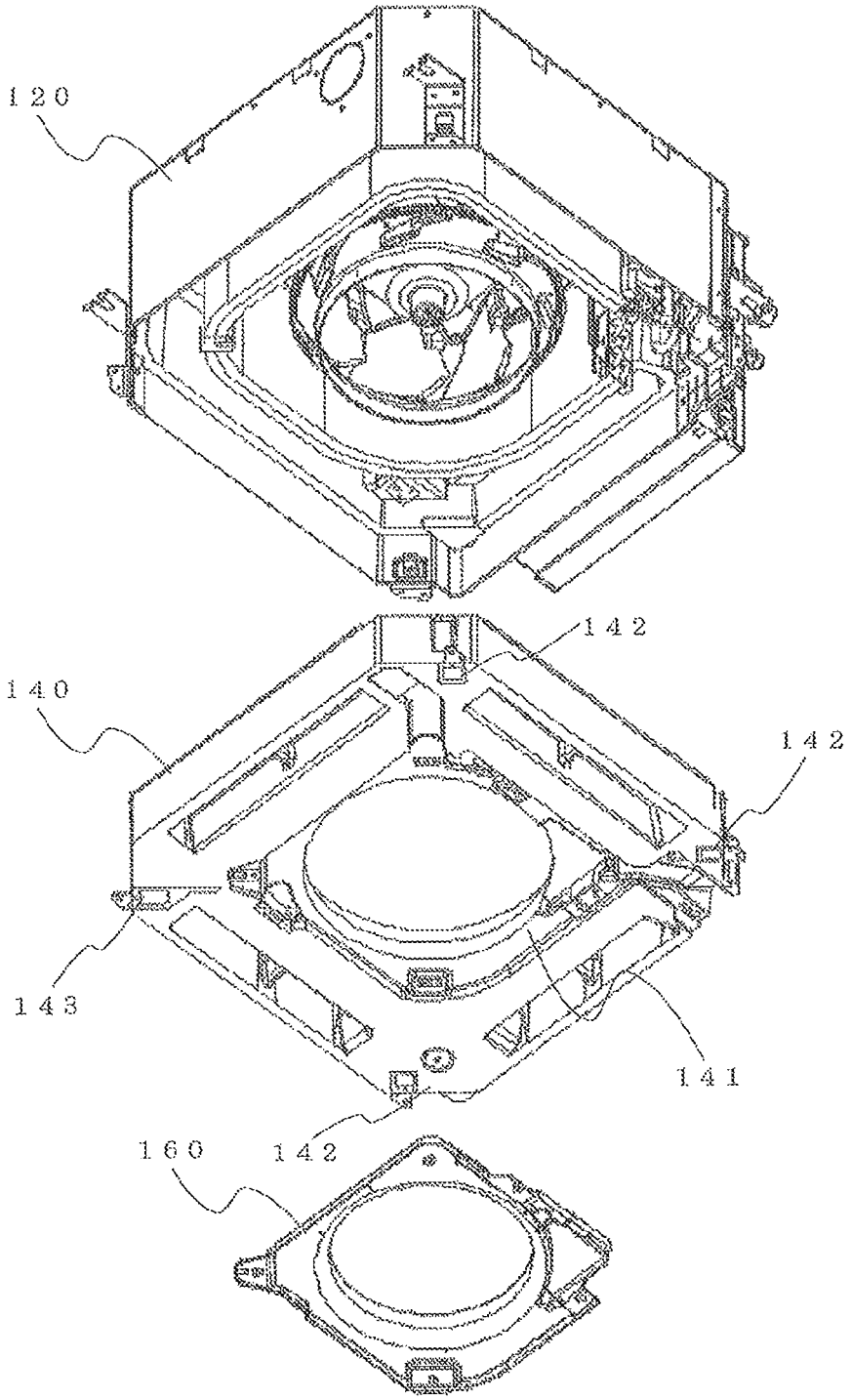
FIG. 3 is an exploded view for illustrating the indoor unit 100 according to Embodiment 1 of the present invention.
Figure 4:
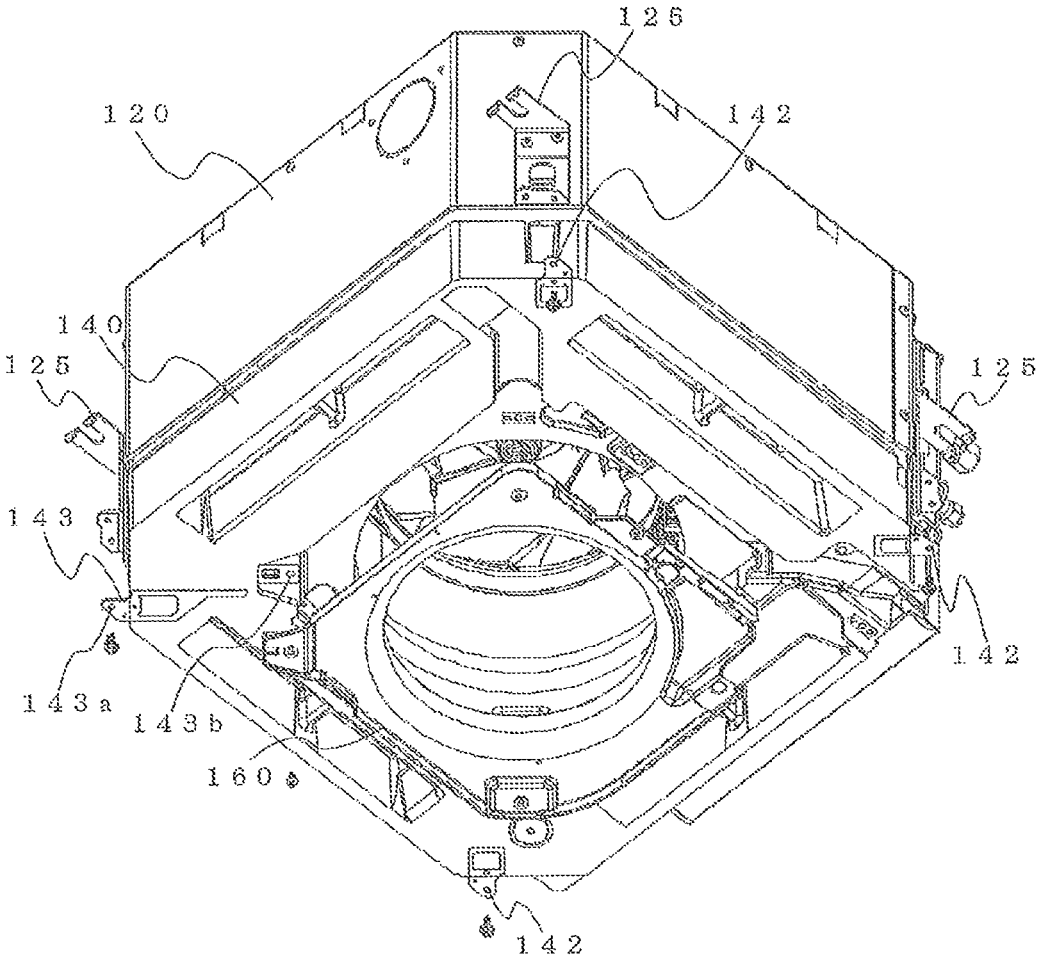
FIG. 4 is an explanatory view for illustrating a mounting relationship between a casing 120, a drain pan 140, and a bellmouth 160 according to Embodiment 1 of the present invention.

FIG. 3 is an exploded view for illustrating the indoor unit 100 according to Embodiment 1 of the present invention. Further, FIG. 4 is an explanatory view for illustrating a mounting relationship between the casing 120, the drain pan 140, and the bellmouth 160 according to Embodiment 1 of the present invention. As illustrated in FIG. 3 and FIG. 4, a recessed portion 141 is formed in the drain pan 140. The bellmouth 160 is mounted to the drain pan 140 by being fitted to the recessed portion 141 and fixed thereto with screws. Further, the drain pan 140 is received in the casing 120, and is mounted to the lateral plates 122 of the casing 120 by being fixed thereto with screws as described below.

As illustrated, for example, in FIG. 2 and FIG. 4, the drain pan 140 includes drain-pan fixing brackets 142 having threaded holes formed so as to allow the casing 120 and the drain pan 140 to be fixed to each other with screws. Methods of fixing the drain pan 140 and the drain-pan fixing brackets 142 to each other are not particularly limited. In this embodiment, the drain-pan fixing brackets 142 are embedded into the drain pan 140 at the time of molding the drain pan 140, for example. With this, the drain pan 140 and the drain-pan fixing brackets 142 are fixed to each other. Further, in this embodiment, device mounts 125 of the casing 120 and the drain-pan fixing brackets 142 are fixed to each other with screws. In addition, the device mounts 125 are arranged at four corners of the casing 120, and hence the device mounts 125 and the drain-pan fixing brackets 142 are fixed to each other with screws at four positions.

Note that, in this embodiment, a positioning fitting 143 configured to allow the bellmouth 160 and the drain pan 140 to be fixed to each other with screws is arranged instead of at least one of the normal drain-pan fixing brackets 142 (at one of the corners in FIG. 2). On one end side of the positioning fitting 143, a casing-fixing threaded hole 143*a* for allowing the casing 120 and the drain pan 140 to be fixed to each other with a screw is formed. On another end side of the positioning fitting 143, a bellmouth-fixing threaded hole 143*b* for allowing the drain pan 140 and the bellmouth 160 to be fixed to each other with a screw is formed. Description of the positioning fitting 143 and other components is made later.

Figure 5:
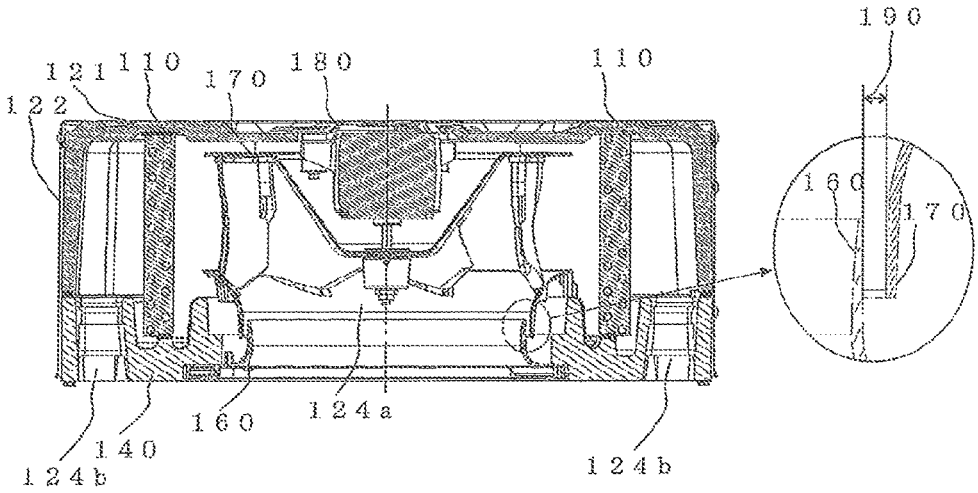
FIG. 5 is a view for illustrating the structure of the indoor unit 100 according to Embodiment 1 of the present invention.

FIG. 5 is a view for illustrating the structure of the indoor unit 100 according to Embodiment 1 of the present invention. On a downstream side of air streams with respect to the turbofan 170, the indoor heat exchanger 110 of, for example, a fin-and-tube type is arranged so as to surround the turbofan 170. When the indoor unit 100 of this embodiment is applied, for example, to an air-conditioning apparatus, the indoor heat exchanger 110 serves as an evaporator during a cooling operation, and serves as a condenser during a heating operation.

Figure 6:
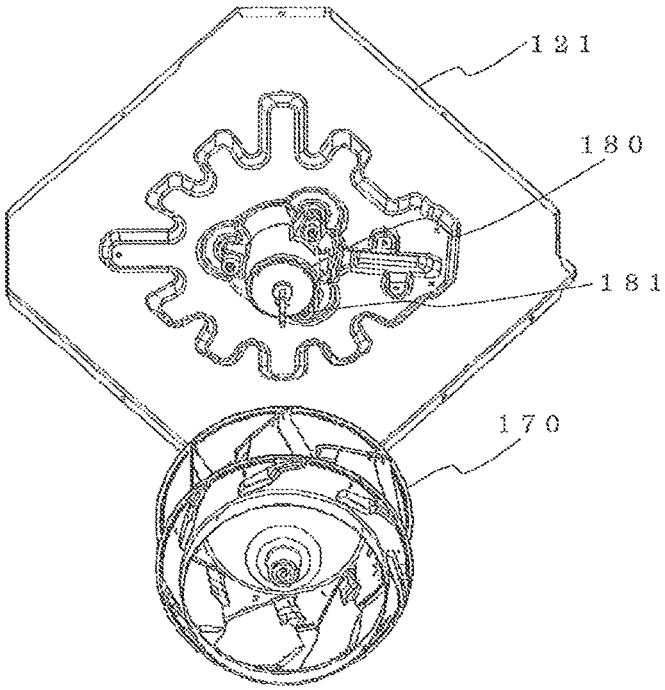
FIG. 6 is a view for illustrating a positional relationship between a motor 180 and a top plate 121 according to Embodiment 1 of the present invention.

FIG. 6 is a view illustrating a positional relationship between a motor 180 and the top plate 121 according to Embodiment 1 of the present invention. As described above, the casing 120 includes the top plate 121 and the lateral plates 122. The motor 180 built in the main unit of the indoor unit 100 is mounted to the top plate 121 so that a central part of the top plate 121 and a rotary shaft 181 are orthogonal to each other. The rotary shaft 181 extends, for example, in a vertical direction. Note that, the motor 180 may be mounted to the top plate 121 so as to be held in contact therewith, or may be mounted to the top plate 121 with a slight clearance therebetween.

Further, the turbofan 170 illustrated in FIG. 5 is an impeller to be used in a blower of a centrifugal type. The turbofan 170 is mounted to the rotary shaft 181 of the motor 180. Along with rotation of the turbofan 170, air streams for conveying the air, which is taken in through the grille 131, toward lateral sides (right-and-left direction in FIG. 5) are generated. Further, as described above, the bellmouth 160 forms the inlet-side air passage to the turbofan 170. As illustrated in FIG. 5, the bellmouth 160 and the turbofan 170 are partially overlapped with each other in an upper-and-lower direction. In addition, in the overlapping part, a clearance (gap) 190 is secured so as to prevent, for example, contact between the bellmouth 160 and the turbofan 170. When a positional relationship between the bellmouth 160 and the turbofan 170 is improper, the clearance 190 may vary in each indoor unit 100. As a result, there is a risk in that indoor units 100 having nonunform unit performance are manufactured. In this embodiment, the positioning fitting 143 is used so as to enhance accuracy in arranging the bellmouth 160 with respect to the turbofan 170, thereby suppressing the variation of the clearances 190 from one indoor unit 100 to another. With this, the indoor units 100 having stable unit performance can be provided.

Figure 7:
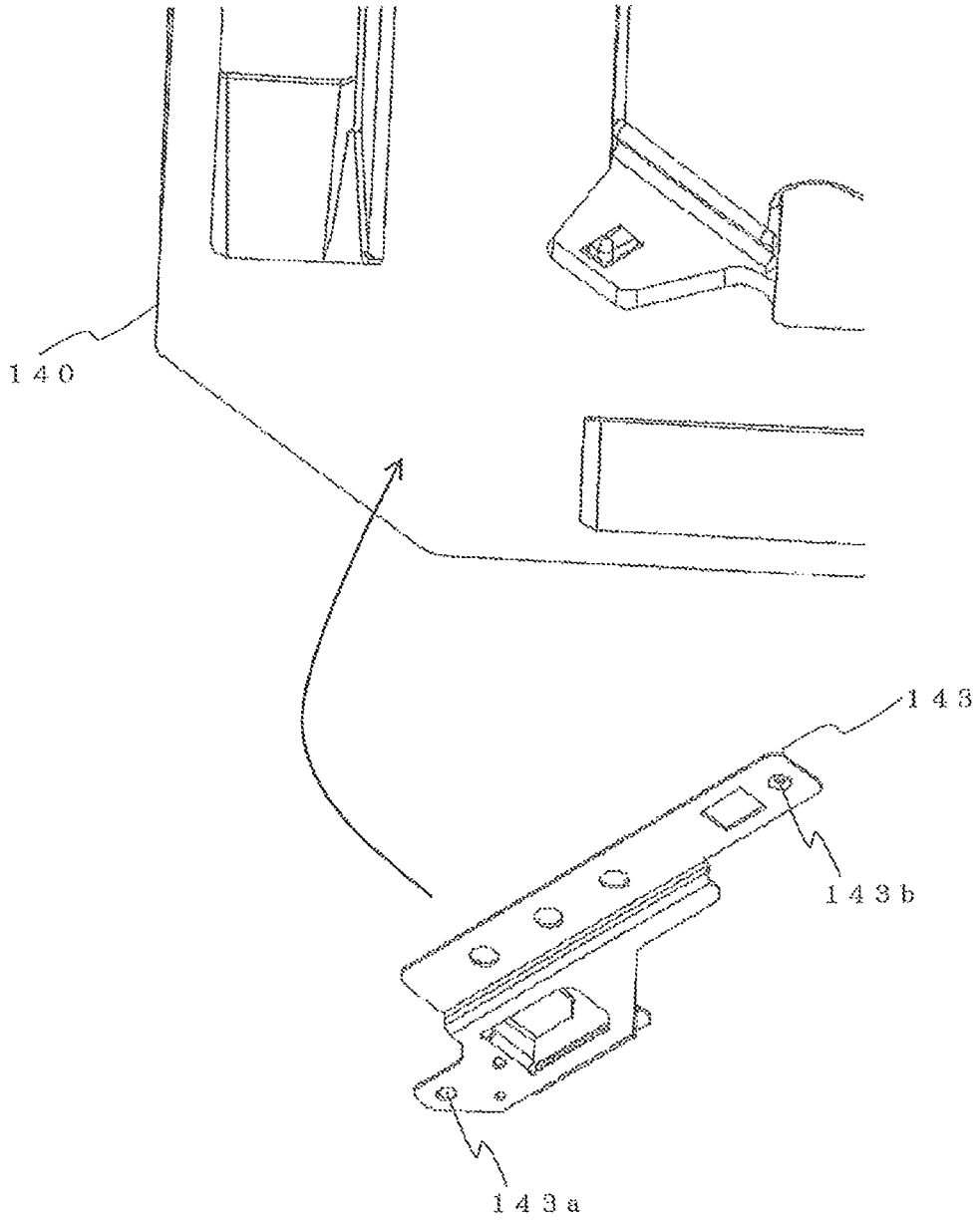
FIG. 7 is a view for illustrating a positioning fitting 143 of the drain pan 140 according to Embodiment 1 of the present invention.

FIG. 7 is a view illustrating the positioning fitting 143 of the drain pan 140 according to Embodiment 1 of the present invention. As described above, the positioning fitting 143 has the casing-fixing threaded hole 143*a* and the bellmouth-fixing threaded hole 143*b* at both the ends so that the casing 120 and the drain pan 140 are fixed to each other with a screw at the one end, and that the drain pan 140 and the bellmouth 160 are fixed to each other with a screw at the other end. As illustrated in FIG. 7, the positioning fitting 143 of this embodiment is formed through processing of a single sheet metal (metal plate). For example, when the casing 120 and the drain pan 140, and the drain pan 140 and the bellmouth 160 are respectively fixed with screws through intermediation of independent fixing brackets as in the related art, variation of positions between the fixing brackets (threaded holes) has a direct influence on the variation of the clearances 190 between the turbofan 170 and the bellmouth 160. In this embodiment, the positioning fitting 143 integrally including the fixing brackets having the threaded holes for allowing the casing 120 and the drain pan 140, and the drain pan 140 and the bellmouth 160 to be respectively fixed to each other with screws is formed by processing a single sheet metal. With this, a positional reference between the casing 120 and the bellmouth 160 (positional relationship between the threaded holes) can be directly set.

Figure 8:
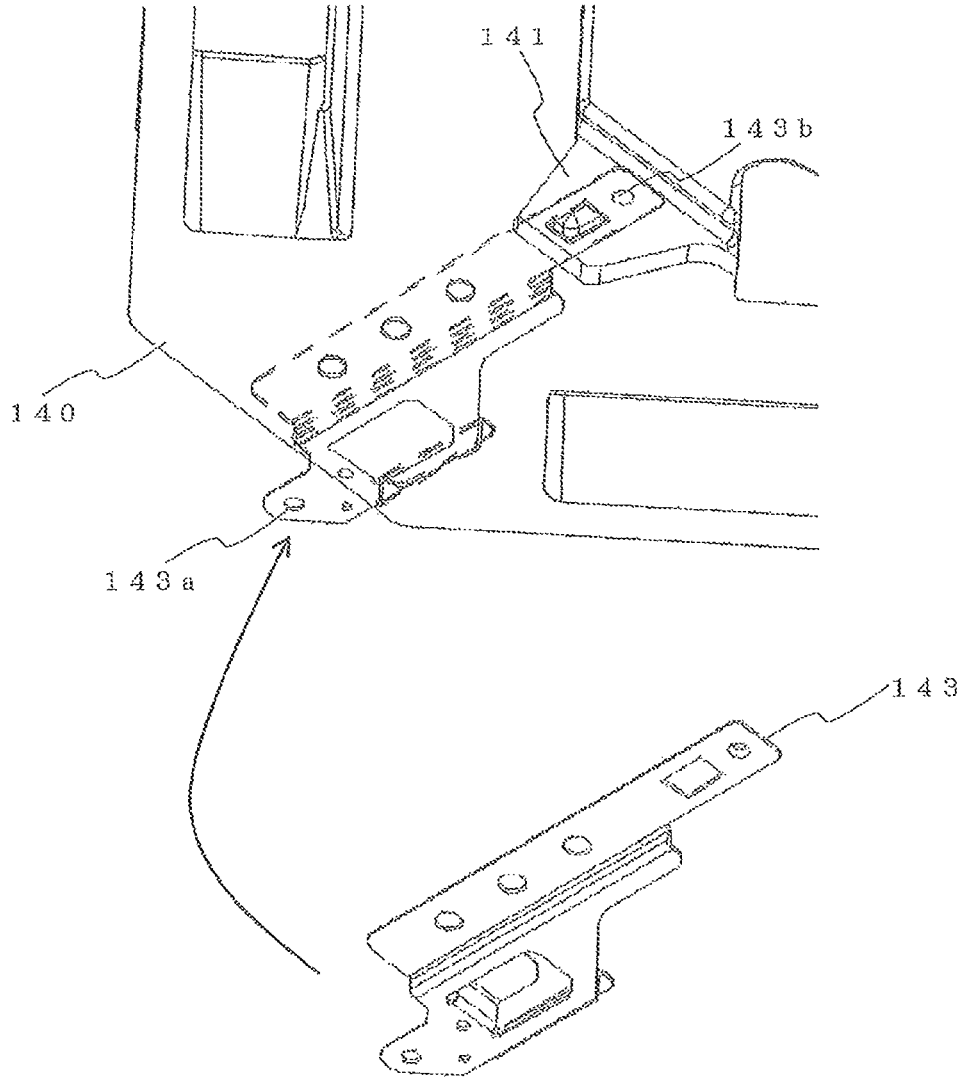
FIG. 8 is a view for illustrating a relationship between the drain pan 140 and the positioning fitting 143 according to Embodiment 1 of the present invention.

FIG. 8 is a view for illustrating a relationship between the drain pan 140 and the positioning fitting 143 according to Embodiment 1 of the present invention. Note that, in FIG. 8, a part of the positioning fitting 143, which is actually embedded in the drain pan 140, is also illustrated. The positioning fitting 143 of this embodiment is processed into a stepped shape in which the casing-fixing threaded hole 143*a* for allowing the casing 120 and the drain pan 140 to be fixed to each other with a screw is positioned so as to be flush with a lower surface side of the drain pan 140, and in which the bellmouth-fixing threaded hole 143*b* for allowing the drain pan 140 and the bellmouth 160 to be fixed to each other with a screw is positioned on a bottom surface of the recessed portion 141.

Figure 9:
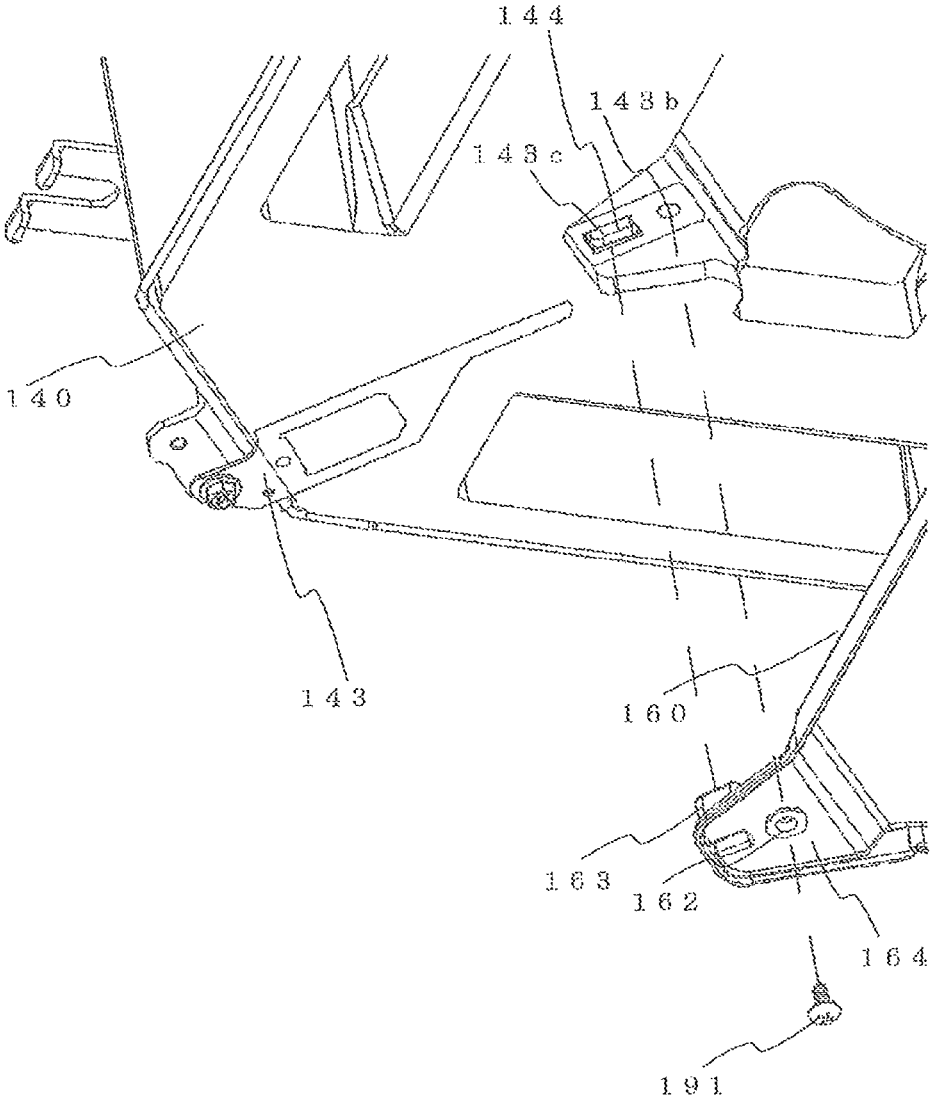
FIG. 9 is a view for illustrating a relationship between the positioning fitting 143 and the bellmouth 160 according to Embodiment 1 of the present invention.

FIG. 9 is a view for illustrating a relationship between the positioning fitting 143 and the bellmouth 160 according to Embodiment 1 of the present invention. In this embodiment, a threaded hole 162 corresponding to the bellmouth-fixing threaded hole 143*b* of the positioning fitting 143 is formed at a part (threaded hole forming portion 164) corresponding to one of the four corners of the bellmouth 160 to be mounted to the drain pan 140. In the bellmouth 160 of this embodiment, the threaded hole forming portion 164 having the threaded hole 162 is formed into a shape different from those of other corners. With this, a direction of mounting the bellmouth 160 to the drain pan 140 can be easily recognized by sight. A screw 191 is inserted into the threaded hole 162 and the bellmouth-fixing threaded hole 143*b*, and is then fastened. With this, the bellmouth 160 is fixed.

Further, the positioning fitting 143 has not only the bellmouth-fixing threaded hole 143*b* but also an oblong hole 143*c* for allowing the bellmouth 160 to be positioned. In addition, the drain pan 140 has a recessed portion 144 formed in conformity with the oblong hole 143*c*.

Figure 10:
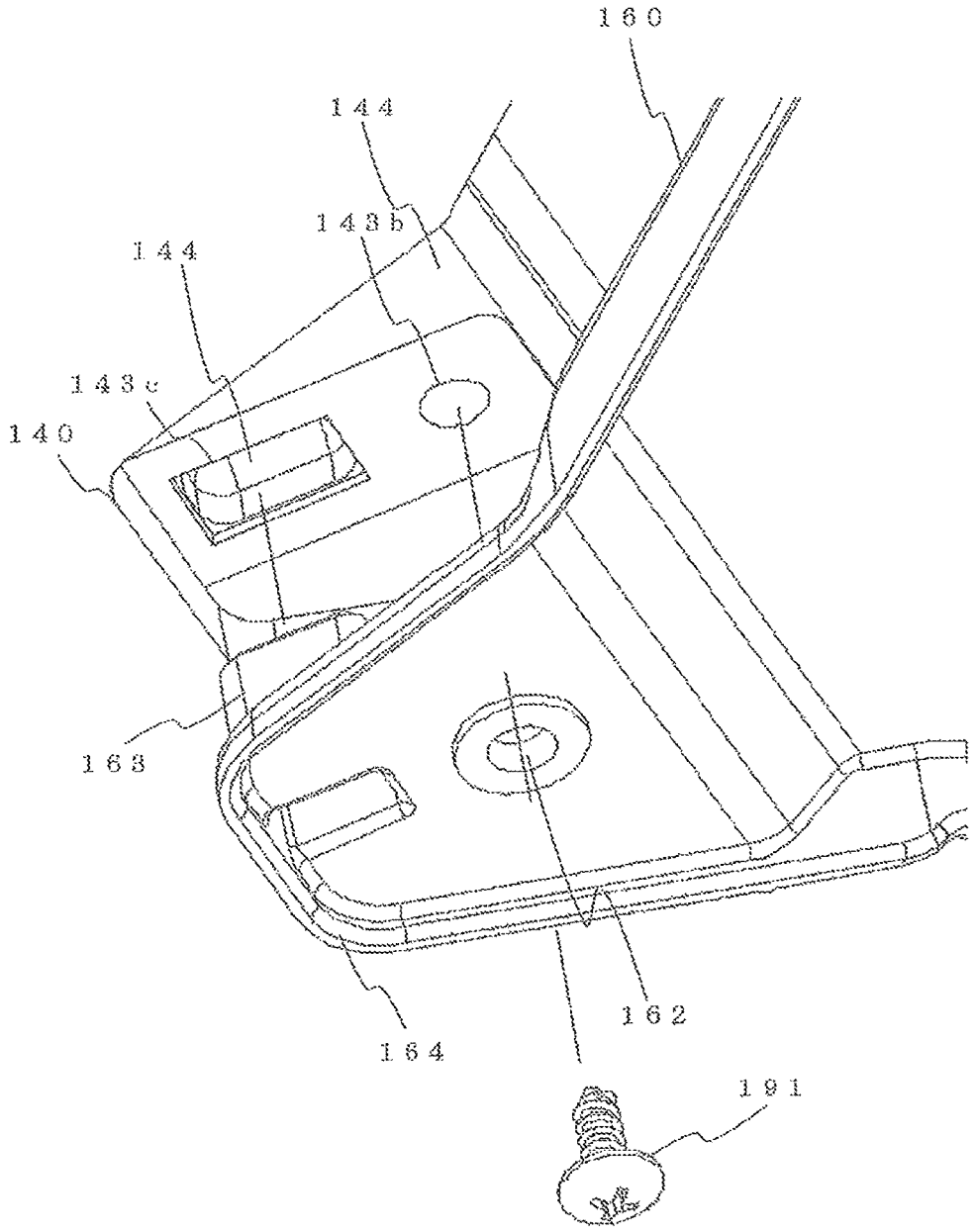
FIG. 10 is a view for illustrating a relationship between an oblong hole 143*c* and a projection portion 163 of the bellmouth 160 according to Embodiment 1 of the present invention.

FIG. 10 is a view illustrating a relationship between the oblong hole 143*c* and a projection portion 163 of the bellmouth 160 according to Embodiment 1 of the present invention. As illustrated in FIG. 10, in the threaded hole forming portion 164 of the bellmouth 160, the projection portion 163 to be fitted into the oblong hole 143*c* of the positioning fitting 143 so as to fix the bellmouth 160 is formed on an opposed surface side with respect to the drain pan 140. When, for example, the drain pan 140 and the bellmouth 160 are fixed to each other only with the screw 191, there is a risk in that the bellmouth 160 is rotationally moved in a horizontal direction about the screw 191 (bellmouth-fixing threaded hole 143*b*). As a countermeasure, the projection portion 163 is inserted into the oblong hole 143*c* (recessed portion 144) so that the horizontal rotational movement of the bellmouth 160, which may occur only with the fixation with the screw, is restricted. Further, both the threaded hole 162 and the projection portion 163 are formed in the threaded hole forming portion 164. Thus, the bellmouth 160 can be positioned only by fixing the single position with the screw 191 coaxially with the threaded hole 162 (note that, other parts of the bellmouth 160 may be vibrated in the upper-and-lower direction, and hence, in this embodiment, the other parts are also fixed with screws).

Note that, in this embodiment, although the oblong hole 143*c* is formed into a rectangular shape, and the projection portion 163 is formed into a rectangular parallelepiped shape, those shapes of the oblong hole 143*c* and the projection portion 163 are not particularly limited. However, a columnar shape needs to be avoided because, even when the columnar projection portion 163 is inserted into the oblong hole 143*c*, the rotation of the bellmouth 160 cannot be restricted. Further, for example, an effect of the restriction is increased as one side of the oblong hole 143*c* is formed so as to be longer than another side.

As described above, in the indoor unit 100 of this embodiment, the drain pan 140 includes the single positioning fitting 143 having the casing-fixing threaded hole 143*a* for allowing the drain pan 140 and the lateral plate 122 of the casing 120 to be fixed to each other with a screw, and the bellmouth-fixing threaded hole 143*b* for allowing the drain pan 140 and the bellmouth 160 to be fixed to each other with a screw. With this, the positional reference between the casing 120 and the bellmouth 160 can be directly set. Thus, a relationship between positions at which the drain pan 140 and the lateral plates 122 of the casing 120 are fixed to each other with screws and positions at which the drain pan 140 and the bellmouth 160 are fixed to each other with screws does not vary in each indoor unit 100. As a result, the variation of the clearance 190 between the turbofan 170 and the bellmouth 160 can be suppressed, thereby being capable of stabilizing the unit performance of each indoor unit 100.

Further, the projection portion 163 formed on the bellmouth 160 side is fitted into the oblong hole 143*c* and the recessed portion 144 formed on the drain pan 140 side. With this, the rotational movement of the bellmouth 160 can be restricted, and a positional relationship between the bellmouth 160 and the drain pan 140 can be maintained.

Embodiment 2

In Embodiment 1 described above, the positioning fitting 143 is formed through processing of a sheet metal. However, the present invention is not limited thereto. For example, the positioning fitting 143 may be formed through molding of a resin material.

Embodiment 3

Figure 11:
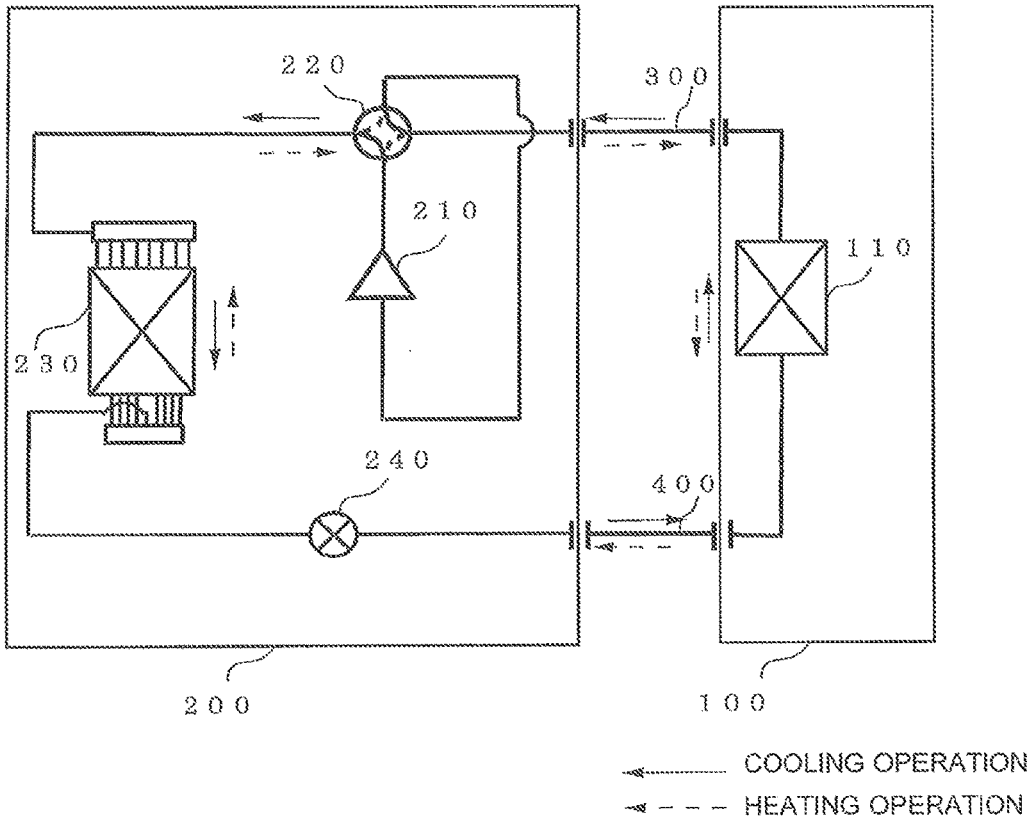
FIG. 11 is a view for illustrating a configuration example of an air-conditioning apparatus according to Embodiment 3 of the present invention.

FIG. 11 is a view for illustrating a configuration example of an air-conditioning apparatus according to Embodiment 3 of the present invention. Note that, in FIG. 11, the air-conditioning apparatus is illustrated as an example of a refrigeration cycle apparatus. In FIG. 11, the same components as those illustrated in, for example, other figures perform the same operations. In the air-conditioning apparatus of FIG. 11, an outdoor unit 200 and the indoor unit 100 are connected to each other by pipes including a gas refrigerant pipe 300 and a liquid refrigerant pipe 400. The outdoor unit 200 includes a compressor 210, a four-way valve 220, an outdoor heat exchanger 230, and an expansion valve 240.

The compressor 210 is configured to compress and discharge sucked refrigerant. Note that, the compressor 210 is not particularly limited, but may include, for example, an inverter circuit so that an operating frequency thereof is arbitrarily changed, thereby being capable of changing a capacity of the compressor 210 (amount of refrigerant sent per unit time). The four-way valve 220 is a valve configured to switch flow of the refrigerant during the cooling operation and flow of the refrigerant during the heating operation to each other, for example.

The outdoor heat exchanger 230 of this embodiment is configured to exchange heat between the refrigerant and the air (outside air). Specifically, the outdoor heat exchanger 230 functions as an evaporator during the heating operation so as to evaporate and gasify the refrigerant, and functions as a condenser during the cooling operation so as to condense and liquefy the refrigerant.

The expansion valve 240 such as an expansion device (flow rate control unit) is configured to decompress and expand the refrigerant. For example, when the expansion valve 240 is constructed by an electronic expansion valve, an opening degree thereof is controlled in response to instructions from a controller (not shown), for example. The indoor heat exchanger 110 is configured to exchange heat between the air to be air-conditioned and the refrigerant, for example. The indoor heat exchanger 110 functions as the condenser during the heating operation so as to condense and liquefy the refrigerant, and functions as the evaporator during the cooling operation so as to evaporate and gasify the refrigerant.

First, description is made of how the refrigerant flows during the cooling operation in the refrigeration cycle apparatus. During the cooling operation, the four-way valve 220 is switched so as to establish a connection relationship as indicated by the solid arrows. Gas refrigerant that has been increased in temperature and pressure through compression by the compressor 210 is discharged therefrom, and then flows into the outdoor heat exchanger 230 via the four-way valve 220. Next, the gas refrigerant is condensed and liquefied into liquid refrigerant through the heat exchange with the outside air by flowing through the outdoor heat exchanger 230, and then flows into the expansion valve 240. The liquid refrigerant turns into refrigerant in a two-phase gas-liquid state through decompression by the expansion valve 240, and then flows out of the outdoor unit 200.

The two-phase gas-liquid refrigerant that has flowed out of the outdoor unit 200 flows into the indoor unit 100 through the liquid refrigerant pipe 400. Next, the two-phase gas-liquid refrigerant is distributed by a distributor and a flow rate control capillary tube (not shown), and then flows into the indoor heat exchanger 110. The two-phase gas-liquid refrigerant turns into gas refrigerant through evaporation and gasification by the heat exchange with, for example, the air to be air-conditioned by flowing through the indoor heat exchanger 110 as described above, and then flows out of the indoor unit 100.

The gas refrigerant that has flowed out of the indoor unit 100 flows into the outdoor unit 200 through the gas refrigerant pipe 300. Then, the gas refrigerant is sucked again into the compressor 210 via the four-way valve 220. Air-conditioning (cooling) is performed by circulating the refrigerant in the air-conditioning apparatus in this way.

Next, description is made of how the refrigerant flows during the heating operation. During the heating operation, the four-way valve 220 is switched so as to establish a connection relationship as indicated by the dotted arrows. Gas refrigerant that has been increased in temperature and pressure through compression by the compressor 210 is discharged therefrom, and then flows out of the outdoor unit 200 via the four-way valve 220. The gas refrigerant that has flowed out of the outdoor unit 200 flows into the indoor unit 100 through the gas refrigerant pipe 300.

The gas refrigerant is condensed and liquefied through the heat exchange with, for example, the air to be air-conditioned by flowing through the indoor heat exchanger 110, and then flows out of the indoor unit 100 through the distributor and the flow rate control capillary tube (not shown).

The liquid refrigerant that has flowed out of the indoor unit 100 flows into the outdoor unit 200 through the liquid refrigerant pipe 400. Then, the liquid refrigerant turns into refrigerant in the two-phase gas-liquid state through the decompression by the expansion valve 240, and then flows into the outdoor heat exchanger 230. Next, the refrigerant is gasified (gas refrigerant) through evaporation and the heat exchange with the outside air by flowing through the outdoor heat exchanger 230. Then, the refrigerant is sucked again into the compressor 210 via the four-way valve 220. Air-conditioning (heating) is performed by circulating the refrigerant in the air-conditioning apparatus in this way.

As described above, in the air-conditioning apparatus (refrigeration cycle apparatus) of this embodiment, the indoor unit 100 described above is used. With this, air-conditioning apparatus having stable unit performance can be provided.

INDUSTRIAL APPLICABILITY

The indoor unit 100 of the embodiments described above is an indoor unit of the four-way cassette type having the four air outlets 132 and the four air outlet vanes 150 so as to flow out air to four sides. However, the present invention is not limited thereto, and is applicable also to, for example, indoor units of other ceiling concealed types adaptable to two-way or three-way air stream. Further, the present invention is applicable not only to the indoor units of such ceiling concealed types, but also to indoor units of other types. In addition, the present invention is applicable also to fans other than the centrifugal fan.

Still further, in the embodiments described above, the air-conditioning apparatus is described as an example of the refrigeration cycle apparatus. However, the present invention is not limited thereto, and is applicable also to, for example, other refrigeration cycle apparatus such as a dehumidifier. In addition, the present invention is applicable not only to the refrigeration cycle apparatus, but also to, for example, blowers and ventilation systems.

The invention claimed is:

1. An indoor unit, comprising:

a casing comprising a top plate and lateral plates;

a motor mounted to a central part on an inner surface side of the top plate;

a fan fixed to a rotary shaft of the motor and configured to rotate through drive of the motor;

a drain pan received in the casing and mounted to the lateral plates of the casing; and a bellmouth mounted to the drain pan and configured to rectify a fluid flowing into the casing, the drain pan comprising a positioning fitting having a casing-fixing threaded hole for allowing the drain pan to be fixed to the casing with a screw; and a bellmouth-fixing threaded hole for allowing the bellmouth to be fixed to the drain pan with a screw, wherein the positioning fitting has an oblong hole for allowing the bellmouth to be positioned in conjunction with the bellmouth-fixing threaded hole, the drain pan has a recessed portion conforming to the oblong hole, and the bellmouth has a projection portion to be fitted into the recessed portion through the oblong hole.

2. The indoor unit of claim 1, wherein the bellmouth and the drain pan are positioned to each other at one position.

3. The indoor unit of claim 2, wherein the positioning fitting is formed by processing a metal plate or a resin.

4. The indoor unit of claim 1, wherein the positioning fitting is formed by processing a metal plate or a resin.

5. An air-conditioning apparatus, comprising:

the indoor unit of claim 1; and an outdoor unit configured to supply heat to the indoor unit side.

6. An air-conditioning apparatus, comprising:

the indoor unit of claim 2;

an outdoor unit configured to supply heat to the indoor unit side.

7. An air-conditioning apparatus, comprising:

the indoor unit of claim 4;

an outdoor unit configured to supply heat to the indoor unit side.

* * * * *